US007414458B2

(12) United States Patent
Wu et al.

(10) Patent No.: US 7,414,458 B2
(45) Date of Patent: Aug. 19, 2008

(54) POWER GATING CIRCUIT OF A SIGNAL PROCESSING SYSTEM

(75) Inventors: Jeng-Huang Wu, Taipei (TW); Yi-Hwa Chang, Hsin-Chu Hsien (TW); Shang-Chih Hsieh, Kao-Hsiung Hsien (TW)

(73) Assignee: Faraday Technology Corp., Science-Based Industrial Park, Hsin-Chu (TW)

( * ) Notice: Subject to any disclaimer, the term of this patent is extended or adjusted under 35 U.S.C. 154(b) by 83 days.

(21) Appl. No.: 11/308,151

(22) Filed: Mar. 8, 2006

(65) Prior Publication Data

US 2007/0210857 A1 Sep. 13, 2007

(51) Int. Cl.
*G05F 1/10* (2006.01)
*G05F 3/02* (2006.01)

(52) U.S. Cl. ..... 327/540; 327/539; 327/541; 327/543; 323/273

(58) Field of Classification Search ..... 327/539–541, 327/543; 323/273, 316, 280
See application file for complete search history.

(56) References Cited

U.S. PATENT DOCUMENTS

| | | | | |
|---|---|---|---|---|
| 5,319,302 | A * | 6/1994 | Koshikawa et al. | 323/273 |
| 7,230,408 | B1 * | 6/2007 | Vinn et al. | 323/273 |
| 2002/0030538 | A1 * | 3/2002 | Morishita | 327/541 |
| 2003/0085693 | A1 * | 5/2003 | Marty | 323/280 |

* cited by examiner

*Primary Examiner*—Quan Tra
*Assistant Examiner*—Colleen O'Toole
(74) *Attorney, Agent, or Firm*—Winston Hsu

(57) ABSTRACT

A power gating circuit of a signal processing system includes a low dropout linear regulator, a control circuit, and an output circuit. The low dropout linear regulator includes a first transistor, an operational amplifier, a first resistor, a second resistor, and an output end. The output circuit includes a fourth transistor and a step-down circuit. The control circuit controls output voltage of the output circuit according to a control signal.

7 Claims, 2 Drawing Sheets

POWER GATING CIRCUIT OF A SIGNAL PROCESSING SYSTEM

BACKGROUND OF THE INVENTION

1. Field of the Invention

The present invention provides a power gating circuit of a signal processing system, and more particularly, a power gating circuit capable of changing a voltage level of output signal according to a voltage level of a control signal.

2. Description of the Prior Art

With the great developments of integrated circuits, semiconductor cell size has diminished to a deep submicron level, which can reduce the production cost of a chip and enhance operation speed and performance. However, as cell size reduces, there are other problems. Compared to past processes, a transistor manufactured by the deep submicron process includes high sub-threshold leakage current. Such problem is not really critical in only one cell, but in a very large scale integrated (VLSI) circuit having a lot of transistors, leakage current from each transistor will be accumulated to a degree that deteriorates the performance of the VLSI circuit. Furthermore, in an idle mode, the VLSI circuit should not generate direct current because no switching operation occurs. However, the accumulated leakage current may make the VLSI circuit unable to operate in the idle mode.

In order to improve leakage current, the prior art, such as a process of operating a deep-submicron metal oxide semiconductor field effect transistor, uses a technology of power gating to shut down unused circuit elements or blocks, so as to reduce leakage current. However, the power gating method may need to provide a set of high-level gate voltages for PMOS power switch, which are generated by an extra circuit and may cause reliability issues in power switches.

SUMMARY OF THE INVENTION

It is therefore a primary objective of the claimed invention to provide a power gating circuit of a signal processing system.

According to the claimed invention, a power gating circuit of a signal processing system comprises a low dropout linear regulator, an output circuit, and a control circuit. The low dropout linear regulator comprises a first transistor having a gate, a source coupled to a first voltage, and a drain, an operational amplifier having a first input end coupled to a bandgap reference voltage, a second input end, and an output end coupled to the gate of the first transistor, a first resistor having one end coupled to the drain of the first transistor, and the other end coupled to the second input end of the operational amplifier, a second resistor having one end coupled to the second input end of the operational amplifier and the first resistor, and the other end coupled to the ground, and an output end between the drain of the first transistor and the first resistor, for outputting a second voltage. The output circuit comprises a fourth transistor having a gate, a source coupled to the first voltage, and a drain, and a step-down circuit coupled between the output end of the low dropout linear regulator and the drain of the fourth transistor, for outputting voltage. The control circuit is utilized for controlling output voltage of the output circuit according to a control signal.

In addition, when turning off power, the present invention can provide a weak voltage having lower voltage, which can be applied to a self controllable voltage level circuit. The self controllable voltage level circuit can hold stored data after power down, and can reduce leakage current.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
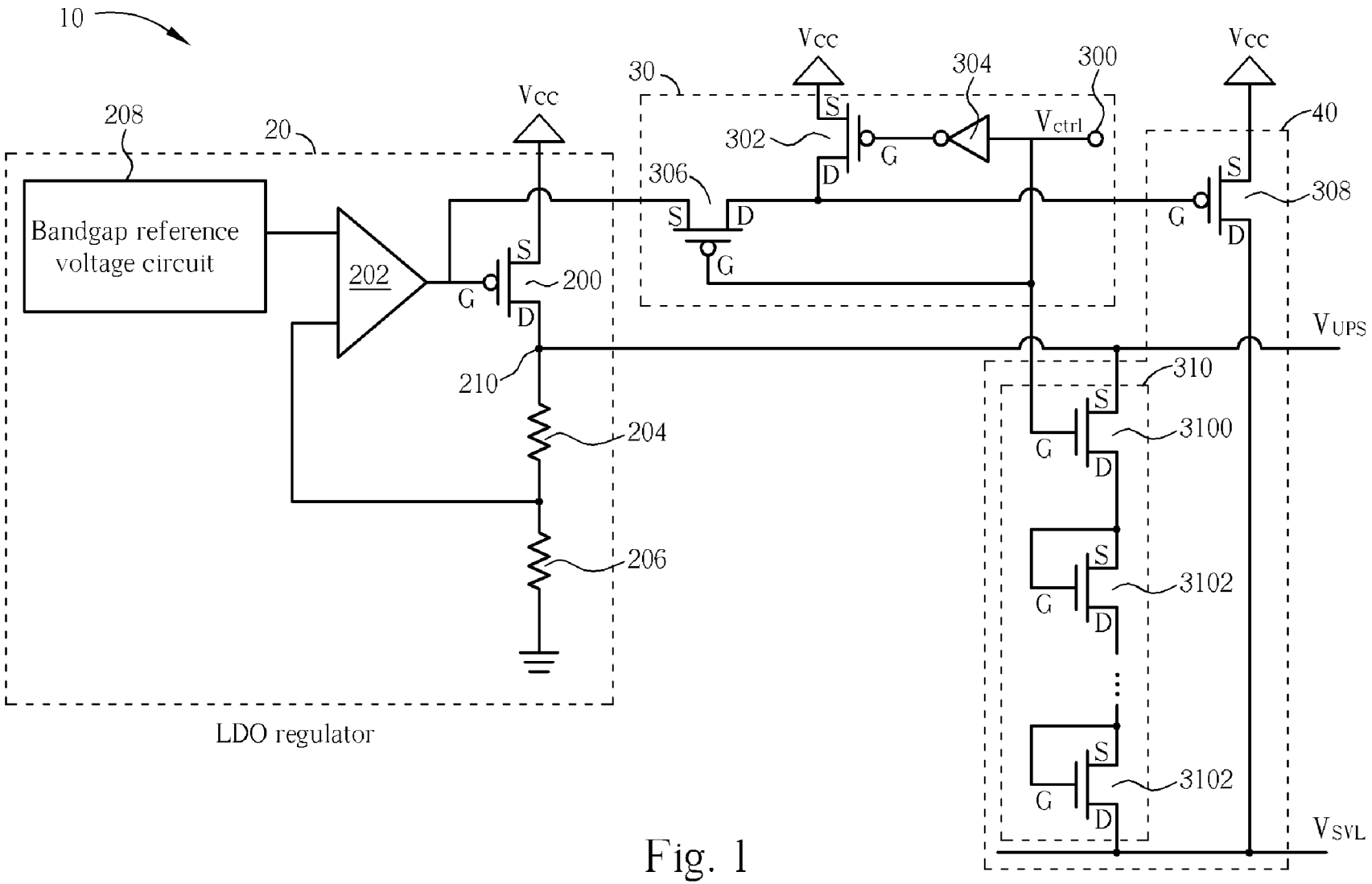
FIG. 1 illustrates a schematic diagram of a power gating circuit in accordance with the present invention.

Please refer to FIG. 1, which illustrates a schematic diagram of a power gating circuit 10 in accordance with the present invention. The power gating circuit 10 includes a low dropout linear regulator 20, a control circuit 30, and an output circuit 40. The low dropout linear regulator 20 includes a transistor 200, an operational amplifier 202, resistors 204 and 206, and a bandgap reference voltage circuit 208. The low dropout linear regulator 20 outputs a voltage $V_{UPS}$ from an output end 210 according to signals outputted from the bandgap reference voltage circuit 208. The control circuit 30 controls output voltage of the output circuit 40 according to a control signal, and preferably includes a control signal reception end 300, transistors 302 and 306, and an inverter 304. The control circuit 30 controls output signals of the power gating circuit 10 according to a control signal $V_{ctrl}$ received by the control signal reception end 300. The output circuit 40 includes a transistor 308 and a step-down circuit 310. The step-down circuit 310 includes a transistor 3100 and/or a plurality of transistors 3102. The output circuit 40 controls a level of a voltage $V_{SVL}$ according to the output signals of the control circuit 30. The transistors 200, 302, 306, and 308 preferably are p-type metal oxide semiconductor field effect transistors, or MOSFETs, and the transistors 3100 and 3102 are n-type MOSFETs.

For clarity, "G", "D", and "S" represent gates, drains, and sources of transistors in FIG. 1. Also, "Vcc" represents system voltage. In the low dropout linear regulator 20, according to signals from the bandgap reference voltage circuit 208 and a feedback signal, the operational amplifier 202 outputs signals to the gate G of the transistor 200 to generate a voltage $V_{UPS}$ from the output end 210. The operational amplifier 202 also outputs signals to the source S of the transistor 306. In the control circuit 30, the inverter 304 converts a voltage level of the control signal $V_{ctrl}$, and transmits the result to the transistor 302. Therefore, when the control signal $V_{ctrl}$ is low, the transistor 302 is cut off, and the transistor 306 is turned on. Oppositely, when the control signal $V_{ctrl}$ is high, the transistor 302 is turned on, and the transistor 306 is cut off. In the output circuit 40, the gate G of the transistor 308 is coupled to the drain D of the transistor 306. Therefore, when the transistor 306 is turned on, gate voltage of the transistor 308 is same as that of the transistor 200. As a result, the drain D of the transistor 308 outputs a voltage that is the same as the voltage $V_{UPS}$ from the output end 210. Furthermore, in the step-down circuit 310, the transistor 3100 is turned on or cut off based on a voltage level of the control signal $V_{ctrl}$. The gate of each transistor 3102 is coupled to its drain D, so each transistor 3102 can reduce its drain voltage a specific value. As to operations of the power gating circuit 10, please refer to following description.

Figure 2:
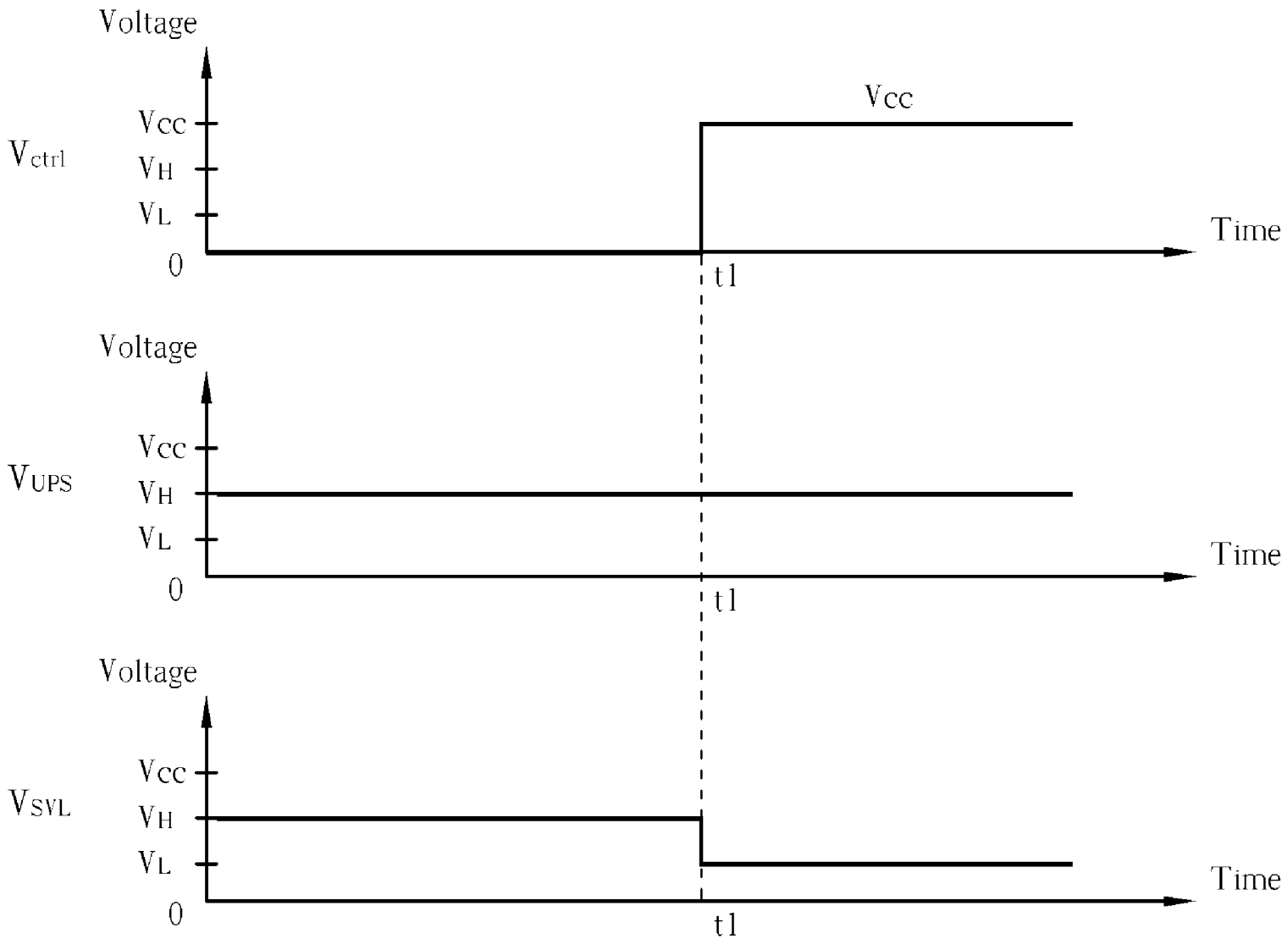
FIG. 2 illustrates a waveform diagram of signals of the power gating circuit in FIG. 1.

Please refer to FIG. 2, which illustrates a waveform diagram of signals of the power gating circuit 10 in FIG. 1. When the control signal $V_{ctrl}$ is low (like at 0 volts), the transistor 302 is cut off, the transistor 306 is turned on, and the transistor 3100 is cut off. Then, gate voltage of the transistor 308 is same as that of the transistor 200, so that drain voltage of the transistor 308 is same as that of the transistor 200, and the step-down circuit 310 is disabled, so the level of the voltage $V_{SVL}$ equals to a level $V_H$ of the voltage $V_{UPS}$. Oppositely, when the control signal $V_{ctrl}$ is changed to high (Vcc) at time point t1, the transistor 302 is turned on, the transistor 306 is cut off, and the transistor 3100 is turned on. Then, the transistor 302 outputs high-state signals to the gate G of the transistor 308 to make the transistor 308 cut off. Meanwhile, the step-down circuit 310 starts to reduce the level $V_H$ of the voltage $V_{UPS}$ outputted from the low dropout linear regulator 20 to a level $V_L$ using the transistors 3102. In other words, when the control signal $V_{ctrl}$ is low, the level of the voltage $V_{SVL}$ equals to the level $V_H$ of the voltage $V_{UPS}$, and when the control signal $V_{ctrl}$ is high, the level of the voltage $V_{SVL}$ equals to the level $V_L$. The voltage Vcc, the levels $V_H$ and $V_L$ can be adjusted according to system requirements. The level $V_H$ is controlled by the low dropout linear regulator 20, and the level $V_L$ is controlled by the amount of the transistors 3102.

Therefore, the power gating circuit 10 controls the level of the voltage $V_{SVL}$ according to the voltage level of the control signal $V_{ctrl}$. In an integrated circuit, such as a system on chip, the voltage $V_{UPS}$ outputted from the low dropout linear regulator 20 is kept in the level $V_H$, so that the power gating circuit 10 can provide a stable power source. In addition, the level of the voltage $V_{SVL}$ is changed based on the voltage level of the control signal $V_{ctrl}$, so the power gating circuit 10 can change operation modes of the integrated circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power gating circuit of a signal processing system comprising:

a low dropout linear regulator comprising:

a first transistor having a gate, a source coupled to a first voltage, and a drain;

an operational amplifier having a first input end coupled to a reference voltage circuit, a second input end, and an output end coupled to the gate of the first transistor;

a first resistor having one end coupled to the drain of the first transistor, and the other end coupled to the second input end of the operational amplifier;

a second resistor having one end coupled to the second input end of the operational amplifier and the first resistor, and the other end coupled to the ground; and an output end between the drain of the first transistor and the first resistor, for outputting a second voltage;

an output circuit comprising:

a fourth transistor having a gate, a source coupled to the first voltage, and a drain; and a step-down circuit coupled between the output end of the low dropout linear regulator, a control signal, and the drain of the fourth transistor, for outputting voltage; and a control circuit for controlling output voltage of the output circuit according to the control signal, the control circuit comprising:

a control signal reception end for receiving the control signal;

a second transistor having a gate, a source coupled to the first voltage, and a drain;

an inverter having one end coupled to the control signal reception end, and the other end coupled to the gate of the second transistor, for inverting the control signal received by the control signal reception end and transmitting to the gate of the second transistor; and a third transistor having a gate coupled to the control signal reception end, a source coupled to the gate of the first transistor, and a drain coupled to the drain of the second transistor and the gate of the fourth transistor.

2. The power gating circuit of claim 1, wherein the second transistor and the third transistor are p-type metal oxide semiconductor field effect transistors.

3. The power gating circuit of claim 1, wherein the step-down circuit comprises:

a fifth transistor having a gate coupled to the control signal reception end, a source, and a drain coupled to the output end of the low dropout linear regulator, for conducting the drain to the gate according to the control signal received by the control signal reception end; and a series of step-down units between the source of the fifth transistor and the drain of the fourth transistor, for decreasing voltage outputted from the source of the fifth transistor.

4. The power gating circuit of claim 3, wherein the fifth transistor is an n-type metal oxide semiconductor field effect transistor.

5. The power gating circuit of claim 3, wherein each of the step-down units is a diode.

6. The power gating circuit of claim 5, wherein each of the step-down units is a metal oxide semiconductor field effect transistor for implementing the diode.

7. The power gating circuit of claim 1, wherein the first transistor and the fourth transistor are p-type metal oxide semiconductor field effect transistors.

* * * * *